United States Patent [19]

Signore et al.

[11] 4,092,056

[45] May 30, 1978

[54] LOCKING DEVICE FOR FILE DRAWERS

[75] Inventors: Dennis J. Signore, Ellicottville; Forest G. Stark, Jamestown, both of N.Y.

[73] Assignee: AVM Corporation, Jamestown, N.Y.

[21] Appl. No.: 821,736

[22] Filed: Aug. 4, 1977

[51] Int. Cl.[2] ..... E05B 65/46

[52] U.S. Cl. ..... 312/219; 312/218

[58] Field of Search ..... 312/218, 219, 216, 217, 312/220, 221

[56] References Cited

U.S. PATENT DOCUMENTS

| | | | |
|---|---|---|---|
| 2,966,384 | 12/1960 | Bergman | 312/218 |
| 3,791,708 | 2/1974 | Signore | 312/221 |

*Primary Examiner*—Casmir A. Nunberg

*Assistant Examiner*—Alex Grosz

*Attorney, Agent, or Firm*—Bean, Kauffman & Bean

[57] ABSTRACT

A locking system for a drawer file cabinet is disclosed. The system includes a locking assembly which is easily installed, removed and replaced without major effort and without major modification to the cabinet. This capability is provided through a novel arrangement of a cam plate pivotally connected to an insertable plunger lock, an internal support bracket uniquely adapted to receive and support and otherwise cooperate with the cam plate and plunger lock, and a reciprocating lock bar permanently mounted within a structural element of the cabinet. With the arrangement provided, only the cam plate and plunger lock are required to convert a cabinet incapable of being locked to a lockable cabinet.

12 Claims, 9 Drawing Figures

Fig. 2.
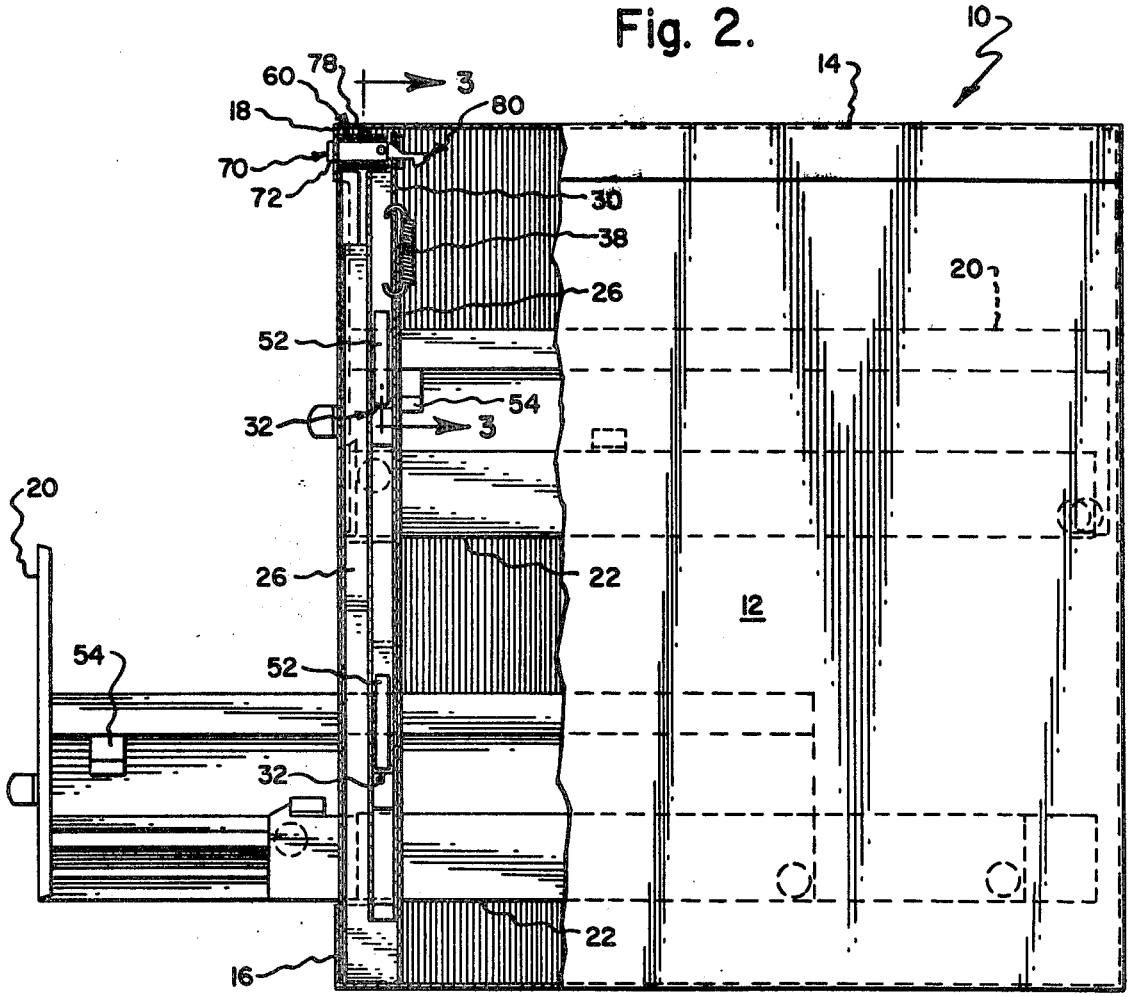
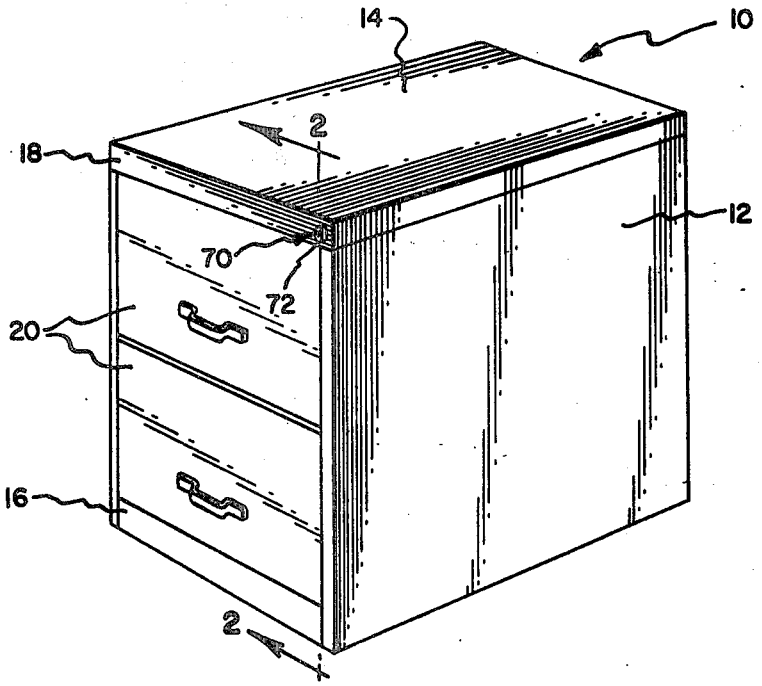
Fig. 1.

Fig. 5.
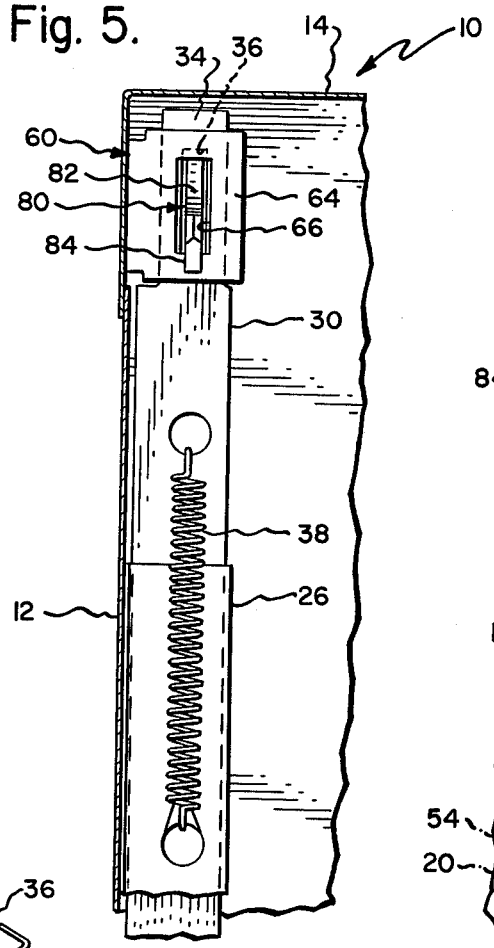
Fig. 6.
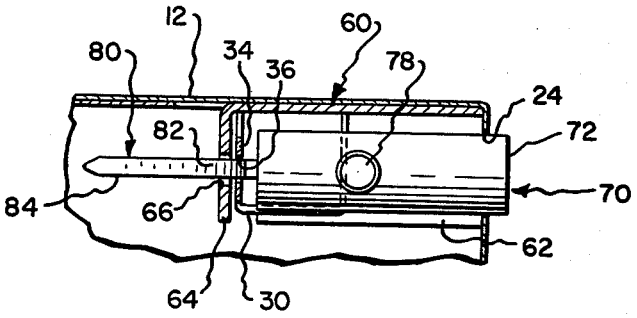
Fig. 7.
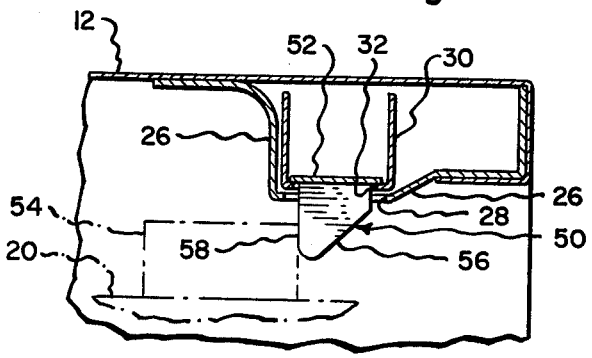
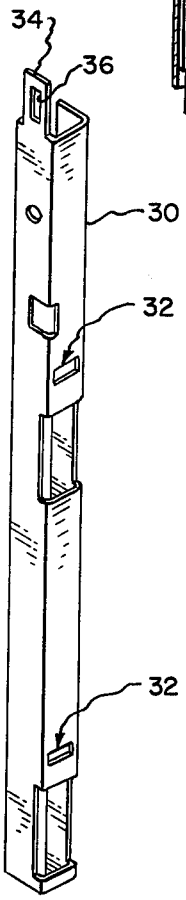
Fig. 8.
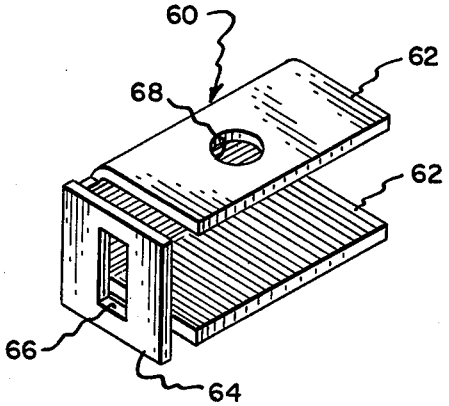
Fig. 9.

LOCKING DEVICE FOR FILE DRAWERS

BACKGROUND OF THE INVENTION

The present invention relates to a locking device for filing cabinets and more particularly to a locking device for "vertical file cabinets" of the type having vertically disposed drawers.

In the commercial area of office equipment and filing cabinets, it has been conventional to market a variety of filing cabinets having a variety of designs, prices, capacities, etc... In order to meet market demand, it has been customary to market differently priced filing cabinets which otherwise differ only by the presence or absence of a locking mechanism. One example of a filing cabinet which incorporates and includes a locking mechanism is to be found in U.S. Pat. No. 3,323,849 issued June 6, 1967. It has been discovered, however, that those customers who originally were content to purchase a less expensive filing cabinet, frequently experience a change in requirements so that they later find the ability to lock the filing cabinet to be desirable. In response to this consomer demand, it is now possible in most designs, to purchase the necessary components required to modify a previously unlockable filing cabinet to one which can secure all of its drawers in a closed and locked position.

The conversion operations and components which have heretofore been available for converting a filing cabinet to a lockable filing cabinet have been unduly complicated so that the task of conversion was difficult to accomplish and quite exasperating. As a result, conversion of most cabinets requires the help of an experienced or mechanically minded person. Additionally, the multiplicity of parts required in the conversion have unduly increased the expense of the modification kit. Both of these effects have resulted from the inadequate design of the cabinets which, in most instances, have not easily accomodated conversion.

In addition to the market demand for a filing cabinet capable of conversion from an unlockable cabinet to a lockable cabinet, it has also been discovered that a need exists for a lockable cabinet with an easily exchangeable locking assembly. There are many circumstances that may arise which jeoparadize the security of a particular cabinet or set of cabinets: such as an unexplained missing key or the loss of a trusted employee or even the expansion of security files into cabinets previously used for non-security purposes. In such circumstances, it would be desireable for the cabinets to be equipped with a locking assembly which could be easily removed and replaced by an unskilled office employee or office manager without the need to call on the services of a locksmith or other skilled mechanic.

Thus is posed the problem of finding a method and apparatus which would permit the production of a standard cabinet useful as an unlockable cabinet and capable of conversion to a lockable cabinet either at the time of manufacture or at a later time which would permit the easy installation, removal and replacement of the lock assembly by an unskilled person. Desirably, such a locking device should be simpler, less aggravating to install, and more economical than has been previously available. The subject invention described below and a preferred embodiment of which follows realizes these objectives in a novel and elegant manner.

SUMMARY OF THE INVENTION

To overcome the deficiencies and disadvantages of the previously known techniques for providing a locking device for cabinet drawers, the subject invention provides a unique arrangement for a file cabinet, as manufactured, which is designed to accommodate the conversion of the cabinet from an unlockable cabinet to a lockable cabinet without the need to alter the cabinet by drilling holes and mounting screw or bolt supported attachments. In the case of a vertically disposed file cabinet having vertically positioned drawers, a locking bar is positioned for reciprocation within a front upright support of the cabinet. Apertures are formed in this front upright support to permit penetration of a resiliently deflectable cantilevered lock hook for each of the drawers in the cabinet. Each lock hook is adapted to engage a locking flange carried by the drawer. With this arrangement, the cabinet may be locked even though one or more drawers are in an extended position. When subsequently moved to a "full-in" position, that drawer or drawers will become automatically locked without the necessity of using a key or otherwise manipulating the locking device.

The locking bar is reciprocated by a lock assembly which is positioned by an interior mounting bracket: constructed to be an integral part of the filing cabinet during the original manufacturing process. A removable knock-out slug is provided to permit access to the interior of the cabinet for positioning the lock assembly in the top of the filing cabinet. When the lock assembly has been inserted through such access hole, it is slideably held by the mounting bracket. The lock assembly itself is specifically adapted to engage and reciprocate the locking bar along its longitudinal axis when the locking assembly is pushed toward and drawn away from the front of the cabinet. Also provided is a support bracket positioned to support the lock bar against lateral deflection caused by the action of the lock assembly. The lock assembly is further designed to be readily removed from the cabinet by providing a latch feature in the cam which may be pivoted to an unlatched position for removal.

Therefore, according to the present invention, all that is required to convert a previously unlockable cabinet to a lockable cabinet is insertion of a specially designed lock assembly adapted to be inserted into the cabinet, said assembly being also adapted to engage the top of the lock bar already present within the cabinet unit. An example resulting from practical application and described hereinafter as a preferred embodiment will show the advantages of the invention in greater detail below. Also the present invention will become apparent to those skilled in the art by reference to the accompanying drawings wherein like reference numerals refer to like elements in the several figures and in which:

FIG. 1 is a perspective view of a typical filing cabinet having a locking assembly installed in the upper right hand front corner;

FIG. 2 is a fragmentary side elevational view of the filing cabinet of FIG. 1 taken along the view lines 2—2;

FIG. 5 is a rear view of the locking device as shown in FIG. 4 taken along the view lines 5—5;

FIG. 6 is a top plan view of the lock assembly of FIG. 4 taken along the lines 6—6;

FIG. 7 is a top view of the latching mechanism of FIG. 4 taken along the view lines 7—7; and FIGS. 8 and 9 are perspective views of the locking bar and the mounting bracket respectively, both shown in FIG. 4.

DESCRIPTION OF THE PREFERRED EMBODIMENT

Figure 3:
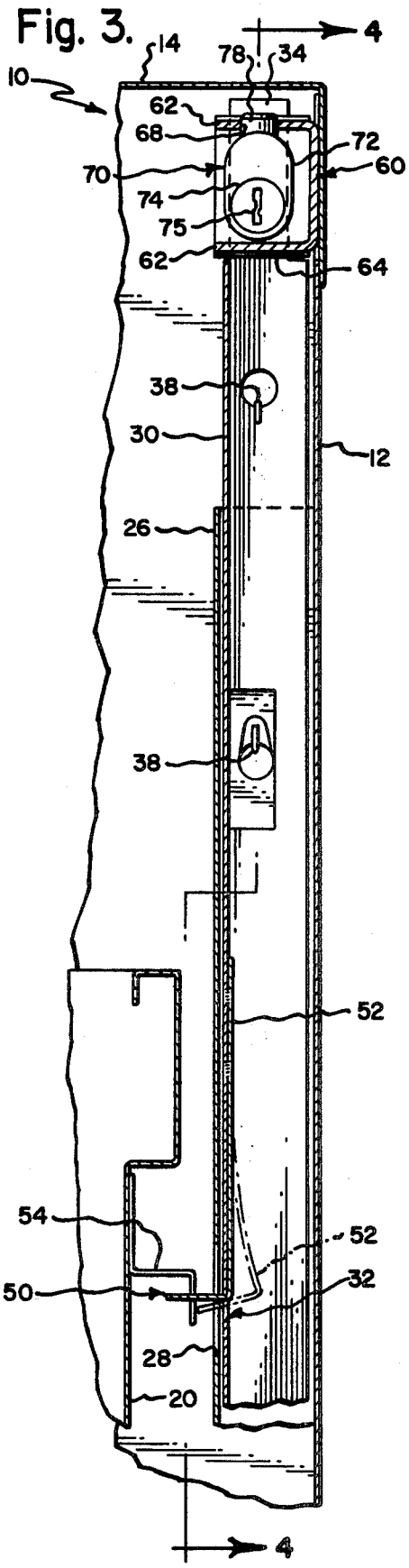
FIG. 3 is a fragmentary vertical section of the locking assembly of FIG. 2 taken along the view lines 3—3.

The invention, as shown in FIG. 1, is embodied in a filing drawer cabinet generally designated at 10. The filing cabinet shown is of the type having horizontally moveable drawers 20 with a sheet metal type casing including opposite side walls 12—12; a top plate 14; and a box-like base portion 16. While not shown, it will be understood that the rear and the bottom of the cabinet will usually be of closed form. The cabinet casing is arranged to support an extendible-retractable, vertically or horizontally aligned series of filing drawers or the like.

Turning now to FIG. 2, the internal structure of the filing cabinet is illustrated. Horizontally moveable drawers 20 are moveably mounted within the cabinet by means of suspension devices or drawer slides 22. While the illustrated suspension devices 22 are of the telescopic roller-supported type, it will be understood that any other type of suspension may be employed in conjunction with the filing drawers.

In accordance with the present invention, a locking system is provided in conjunction with the moveable drawers which provides means for locking all of the drawers in a closed position or, alternatively, which provides means for locking the cabinet with one or more of the drawers in an extended position and for locking the extended drawer/drawers when they are subsequently moved to their full-in positions. Furthermore, the locking system herein disclosed is designed to facilitate the conversion of a standard, unlockable filing cabinet to a lockable filing cabinet by the simple and easy installation of a lock assembly. The lock assembly may also be readily removed for exchange with a substitute locking assembly. Thus, the present invention provides the capability of replacing a lock for security purposes or for the easy removal and exchange of the lock in the event that the lock becomes broken, jammed or otherwise inoperable.

As shown herein by way of example, the locking system of the invention includes a vertically shiftable, longitudinally extending lock bar 30 adjacent to the drawers 20 to be locked and mounted for reciprocation in its longitudinal direction between a first, unlocked position and a second, locked position. Lock bar 30, shown in FIG. 8 as preferably having a channel shape with an upwardly extending plate extension 34 at its top end and having a rectangular aperture 36 therethrough, is desirably included as a permanent part of the filing cabinet and is permanently mounted and captured within a structural reinforcement comprising a longitudinally extending channel structural member 26. In one form of construction, the channel structural member 26 itself is received within and secured by means of spot welding or other permanent means of attachment to a channel formed by folding over an extended portion of side panel 12. Member 26 thus comprises a front upright formed integrally with the cabinet 10.

As best seen in FIG. 5, structural member 26 is interrupted or terminated at one end thereof short of the top of the filing cabinet 10. In this manner, lock bar 30 is permitted to project out through the end of the structural member 26 permitting access thereto. Spring means 38 may be operatively disposed so as to resiliently bias the lock bar 30 to assume its downward unlocking position. In the embodiment shown, spring 38 engages both the lock bar 30 and the structural member 26.

Locking means are operatively disposed between drawers 20 and lock bar 30 and are provided for preventing movement of the drawers from their full-in positions when the lock bar 30 is in its locked position. The locking means, best seen in FIG. 3, consists of a first lock portion 50 mounted on and carried by lock bar 30 and a second lock portion 54 mounted on and carried by each drawer 20. One of the first and second lock portions (50, 54) are resiliently deflectable to permit the closing and locking of drawer 20 from an open withdrawn position to a closed, full-in position while lock bar 30 is in its locked position. In the preferred embodiment shown in FIG. 3, the resilient portion includes lock hook 50 mounted on cantilever spring 52 which is in turn welded or otherwise mounted on lock bar 30. Lock hook 50 includes a camming surface 56 angled with respect to the direction of travel of drawer 20 and a retaining surface 58 oriented perpendicular to the direction of travel of drawer 20. Camming surface 56 is provided for interacting with the second lock portion or bracket 54 when lock bar 30 is in its second position to deflect lock hook 50 as drawer 20 is being moved to its full-in position. Retaining surface 58 serves the function of locking the drawer in such full-in position when lockbar 30 is elevated. When lockbar 30 is lowered, hook 50 is moved to an elevation lower than bracket 54 so that the drawer may be opened. Cantilever spring 52 preferably is mounted on the interior of channel shaped lock bar 30. Accordingly, lock bar 30 is provided with appropriate apertures 32 to permit penetration and operation therethrough of lock hook 50. In a similar manner, structural member 26 is also provided with apertures 28 for traversal thereof of lock hook 50.

Figure 4:
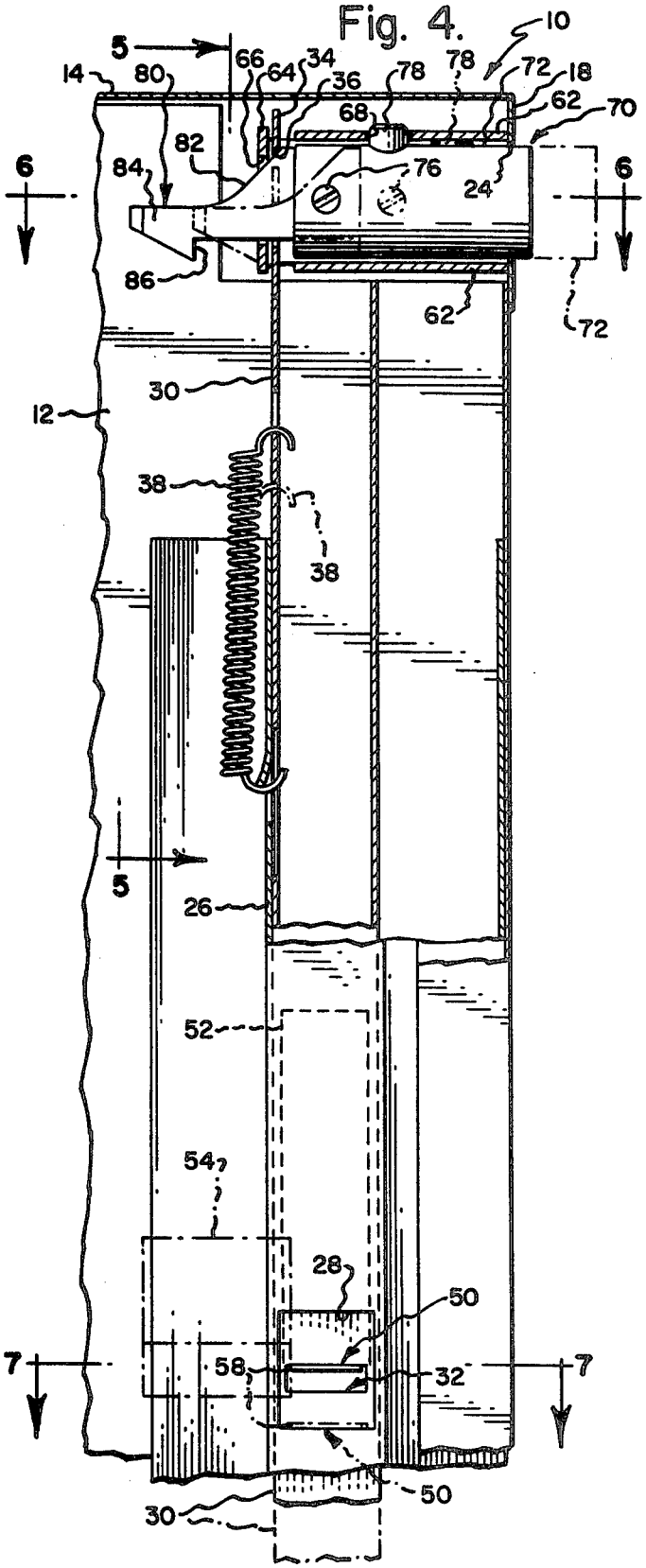
FIG. 4 is a view of the locking device shown in FIG. 3 taken along the view lines 4—4.

In order to accomodate the conversion of an unlockable filing cabinet to a lockable filing cabinet, cabinet 10 includes an internally mounted bracket 60 for positioning and holding a lock assembly 70 (when inserted) in its operative position and a removeable slug in the exterior housing adjacent to bracket 60, removal of which provides an access hole 24 through which a locking assembly may be inserted. As may best be seen in FIGS. 3, 4 and 5, mounting bracket 60 is positioned at the top of the abbreviated structural front upright 26 and is permanently fastened to the interior of the cabinet housing. Lock assembly support 60 forms a guiding channel and supports lock assembly 70 for reciprocation between an inserted, locked position and a withdrawn, unlocked position. Such a lock assembly support or mounting bracket 60 is illustrated in perspective in FIG. 9 where it can be seen that the bracket consists of upper and lower horizontal flanges 62 and an end plate 64. The upper horizontal flange 62 includes an aperture 68 therethrough and end plate 64 includes a rectangular aperture 66. Bracket 60 is attached by means of spot welding or other suitable means to the interior surface of a downwardly extending portion of top plate 14 in alignment with the access hole 24 so that the lock assembly 70 may be slipped through the access hole and into the bracket 60 with little difficulty. The position of bracket 60 is such that end plate 64 is positioned adjacent to extension plate 34 of lock bar 30 so as to support plate 34 against lateral deflection caused by the engagement of the lock assembly 70 therewith.

All of the previously described elements of the filing cabinet, with the exception of the lock assembly 70, are preferably included in the standard file cabinet, whether of the lockable or unlockable type. Accordingly, a purchaser who purchases an unlockable cabinet and who wants to convert it to a lockable cabinet, lacks only the lock assembly. Thus, the locking bar 30, the first and second locking portions 50 and 54, as well as the mounting bracket 60 are all interiorally provided awaiting the conversion of the cabinet to a lockable cabinet. In this original form, the knock-out slug remains in the face of the cabinet so that a complete and uniform appearance is presented.

As previously indicated, conversion of the unlockable cabinet to a lockable cabinet requires only the insertion of a lock assembly 70 (hereafter to be described) through access hole 24 provided by removal of the knock-out slug (not shown). Lock assembly 70 generally consists of a plunger type lock 72 having a cylinder 74 with a key hole 75. Rotation of a key inserted into the cylinder 74 selectively retracts a lock bolt 78. Lock bolt 78 is spring biased to automatically return to an extended position. The previously described aperture 68 in top horizontal flange 62 is adapted to receive lock bolt 78. The vertical dimension of the channel formed by the mounting bracket 60 is such that the plunger 72 of the lock assembly 70 may just be inserted into and slid in the channel. In order to accomplish complete insertion, lock bolt 78 must simply be held in a retracted position by rotation of a key in key hole 75 and simultaneously pushed toward the face of the cabinet. Accordingly, when lock assembly 70 has been successfully inserted through aperture 24 and slidingly received within mounting bracket 60, further insertion after the key has been released continues until lock bolt 78 is positioned adjacent to aperture 68. At this point, spring loaded lock bolt 78 snaps into place in aperture 68 thereby locking the lock assembly in an inserted position and preventing outward movement of the lock assembly until the key is operated to turn cylinder 74.

A cam plate 80 is afixed to the innermost end of plunger 72 of lock assembly 70. Cam plate 80 is formed in a manner which permits it to be inserted through access hole 24 formed in the housing of cabinet 10 and includes inwardly and downwardly extending inclined cam surface 82 formed at an acute angle to the direction of reciprocation of lock bar 30. As may best be seen in FIG. 4, movement of lock assembly 70 into position within the cabinet 10 causes cam plate 80 to be inserted into the rectangular aperture 36 of extension plate 34 of lock bar 30. The position of lock assembly 70 and the cam plate 80 when cam surface 82 first contacts lock bar extension plate 34 is shown in phantom in FIG. 4. Continued movement of lock assembly 70 into the cabinet to the point where lock bolt 78 snaps into locking position in aperture 68, causes plate extension 34 to ride up on cam surface 82 thereby moving the lock bar from a lower unlocked position to a raised locked position. This action exerts a horizontally directed force on plate 34 which is resisted by support plate 64. Subsequent unlocking of the lock assembly 70 causes the lock bolt 78 to disengage itself from aperture 68. When this occurs, lock assembly 70 is thrust outwardly from the cabinet 10 by the interaction of the downwardly biased lock bar 30 and plate extension 34 with the slanted cam surface 82. This construction therefore provides means for translating the in and out reciprocation of lock assembly 70 into an up and down reciprocation of lock bar 30.

Cam plate 80 also includes an extension having a hook projection 84 thereon. Hook projection 84 includes a retaining shoulder 86 oriented normal to the direction of movement of the lock assembly 70. Shoulder 86 prevents the complete withdrawal of lock assembly 70 from cabinet 10. As may readily be seen, the extension of cam plate 80 and hook projection 84, when completely inserted, pass through not only the rectangular aperture 36 of the lock bar plate extension 34 but also through rectangular aperture 66 of end plate 64 of mounting bracket 60. In order that this might be accomplished, cam plate 80 is pivotally mounted for pivotal movement between a lock assembly removal preventive position and a lock assembly removal permissive position by means of pivot screws 76 to the end of plunger 72. Accordingly, as plunger 72 is inserted into the cabinet, hook projection 84 is permitted to ride up and over the obstacle presented by the lower portion of aperture 66. After complete insertion of lock assembly 70 into the cabinet, subsequent attempts to remove the plunger 72 and hence lock assembly 70 from cabinet 10 is prevented by interaction of retaining surface 86 with end bracket 64. Therefore, bracket 64 acts as a stop member fixed against outward movement for engaging shoulder 86 and unauthorized removal of the locking assembly 70 from the cabinet 10 is impossible when the drawers of the cabinet are locked. However, when the cabinet is unlocked and the top drawer extended, intentional, authorized removal of the lock assembly may be accomplished by the mere act of pivoting the cam plate 80 to its clockwise most position by lifting up on the hook projection 84 while at the same time drawing the lock assembly plunger 72 out of the cabinet. Thus, it can be seen that the above described locking system prevents outward movement of the lock assembly 70 from its projecting, unlocked position when the lock bar 30 is in its unlocked position but permits complete outward removal of the lock assembly 70 from the cabinet 10 when the lock bar 30 has been manually lifted to its normally locking position.

What is claimed is:

1. An improved drawer cabinet having a lock unit which may readily be inserted or removed, said cabinet of the type having horizontally moveable drawers, said cabinet having a longitudinally extending lock bar mounted adjacent to said drawers for reciprocation in its longitudinal direction between a first, unlocked position, and a second, locked position, said lock bar being resiliently biased to assume said first position, said cabinet also including locking means operatively disposed between said drawers and said lock bar for locking said drawers, and an access hole into the interior of said cabinet, the improvement comprising:

a. a lock assembly slidingly mounted in said access hole for reciprocation between a projecting, unlocked position and a relatively depressed, locked position, said lock assembly having a cam surface formed at an acute angle to the direction of reciprocation of said lock bar for engaging and for moving said lock bar between said first and second positions as said lock assembly is moved between said projecting and depressed positions respectively; and b. means for preventing the outward movement of said lock assembly from its projecting position when said lock bar is in said first position and for permitting complete outward removal of said lock assembly from said cabinet when said lock bar is in its second position.

2. The improved drawer cabinet as recited in claim 1 wherein said means for preventing outward movement of said lock assembly includes a shoulder carried by said lock assembly, said shoulder extending substantially normal to the direction of reciprocation of said lock assembly, said means for preventing outward movement of said lock assembly further including a stop member attached to said cabinet and fixed against outward movement for engaging said shoulder.

3. The improved drawer cabinet as recited in claim 2 wherein said cabinet further includes a support member for preventing lateral deflection of said lock bar normal to its direction of reciprocation when said lock bar is moved longitudinally by engagement with said lock assembly cam surface.

4. The improved drawer cabinet as recited in claim 3 wherein said shoulder and said cam surface are formed on a cam plate pivotally connected to said lock assembly for pivotal movement between a lock assembly removal preventive position and a lock assembly removal permissive position.

5. The improved drawer cabinet as recited in claim 4 wherein said cam surface is configured to be inwardly facing when said lock assembly is mounted in said access hole.

6. The improved drawer cabinet as recited in claim 5 wherein said cam surface extends inwardly and downwardly and wherein said lock bar includes an upwardly extending plate having an aperture adapted to permit penetration therethrough of said cam plate so that a portion of said lock bar extension plate is able to contact said cam surface.

7. The improved drawer cabinet as recited in claim 6 wherein said shoulder is positioned on a side of said cam plate opposite to said cam surface.

8. The improved drawer cabinet as recited in claim 7 wherein said cam plate has a pointed innermost profile in order to facilitate the insertion of said cam plate through said aperture of said lock bar extension plate.

9. The improved drawer cabinet as recited in claim 8 wherein said cam plate is sized relative to said cabinet access hole to permit its passage therethrough from the exterior of the cabinet.

10. The improved drawer cabinet as recited in claim 9 wherein said stop member fixed against outward movement for engaging said shoulder includes said support member for preventing lateral deflection of said lock bar, said support member including a support bracket positioned on the inward side of said lock bar extension plate, said support bracket also having an aperture adapted to permit penetration therethrough of said cam plate and positioned in registry with said aperture in said lock bar extension plate.

11. The improved drawer cabinet as recited in claim 10 wherein said locking means operatively disposed between said drawers and said lock bar for locking said drawers including a lock hook resiliently mounted on one end of a cantilever spring, the other end of which is rigidly fixed to said lock bar, said lock hook including a camming surface angled with respect to the direction of travel of said drawer and retaining surface normal to the direction of travel of said drawer.

12. The improved drawer cabinet as recited in claim 1 wherein said locking means operatively disposed between said drawers and said lock bar for locking said drawers includes a lock hook resiliently mounted on one end of a cantilever spring, the other end of which is rigidly fixed to said lock bar, said lock hook including a camming surface angled with respect to the direction of travel of said drawer and a retaining surface normal to the direction of travel of said drawer.

* * * * *

UNITED STATES PATENT AND TRADEMARK OFFICE

CERTIFICATE OF CORRECTION

PATENT NO. : 4,092,056

DATED : May 30, 1978

INVENTOR(S) : Dennis Signore and Forest G. Stark

It is certified that error appears in the above-identified patent and that said Letters Patent are hereby corrected as shown below:

Col. 2, line 54 - After the word "detail" please delete the word --- below ---.

CLAIM 1:

Col. 7, line 1 - After the word "means" please insert --- depending from and operably associated with said lock assembly and which coacts with said lock bar".

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*